US006739695B2

(12) United States Patent
Yoshimura et al.

(10) Patent No.: US 6,739,695 B2
(45) Date of Patent: May 25, 2004

(54) PRINTING APPARATUS

(75) Inventors: Sohichi Yoshimura, Yamatokoriyama (JP); Hiroki Etoh, Ueno (JP); Naoyuki Kamei, Ikoma-gun (JP); Michiaki Nishimura, Yoshino-gun (JP); Yoshinori Hayashi, Souraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/256,129

(22) Filed: Sep. 27, 2002

(65) Prior Publication Data

US 2003/0063177 A1 Apr. 3, 2003

(30) Foreign Application Priority Data

Sep. 28, 2001 (JP) ..... 2001-302061

(51) Int. Cl.[7] ..... B41J 2/165

(52) U.S. Cl. ..... 347/30; 347/23; 347/29; 347/32; 347/33; 347/35

(58) Field of Search ..... 347/22, 23, 24, 347/29, 30, 32, 35, 33, 34, 19

(56) References Cited

U.S. PATENT DOCUMENTS 5,896,143 A * 4/1999 Matsui et al. ..... 347/24
6,139,128 A * 10/2000 Magirl et al. ..... 347/22
6,345,878 B1 * 2/2002 Kanaya ..... 347/23
6,616,266 B2 * 9/2003 Neal et al. ..... 347/35

FOREIGN PATENT DOCUMENTS

| | | |
|---|---|---|
| EP | 1 080 900 A1 | 3/2001 |
| JP | 2-162056 A | 6/1990 |
| JP | 2001-71587 | 3/2001 |

* cited by examiner

*Primary Examiner*—Shih-Wen Hsieh
(74) *Attorney, Agent, or Firm*—Birch, Stewart, Kolasch & Birch, LLP

(57) ABSTRACT

A printing apparatus includes a print head section having a nozzle for discharging ink; a paper feed section for feeding paper in a paper feed direction; a movement section for reciprocally moving the print head along a track formed in a direction perpendicular to the paper feed direction; a maintenance section for performing a maintenance operation on the nozzle; a case for accommodating the above-mentioned sections; a cover attached to the case in an openable and closable manner; a detection section for detecting open and closed states of the cover and outputting detection signals representative of the open and closed states of the cover; and a control section for controlling drive of the movement section and the maintenance section according to the detection signals output by the detection section. The maintenance section includes two maintenance stations mounted on both ends of the track, and the control section gives an instruction such that the print head moving to one of the maintenance stations is stopped at a stop position established on the track, in response to the detection signal representative of the open state of the cover.

11 Claims, 8 Drawing Sheets

PRINTING APPARATUS

CROSS-REFERENCE TO RELATED APPLICATION

This application is related to Japanese Patent Application No. 2001-302061 filed on Sep. 28, 2001, whose priority is claimed under 35 USC § 119, the disclosure of which is incorporated by reference in its entirety.

BACKGROUND OF THE INVENTION

1. Field of the Invention

The present invention relates to a printing apparatus, more particularly a printing apparatus provided with a maintenance section for performing maintenance for a print head of inkjet type.

2. Description of Related Art

Usually, an ink-jet printer is provided with a maintenance station for executing a maintenance operation on its print head by wiping an ink discharge nozzle of the print head, discharging ink from the nozzle or sucking ink out of the nozzle before sealing (capping) the nozzle. The maintenance station is typically mounted on one end of a track on which the print head is placed. The track is provided in a direction perpendicular to a paper feed direction.

In such an ink-jet printer, the print head is moved to the maintenance station provided with a cap section, and the above-mentioned maintenance is done. The maintenance operation is performed regardless of the printing operation of the print head.

Also a cover is reclosably attached to a case of the printer for allowing user's maintenance such as replacement of the print head and an ink tank of the print head placed on the track.

In the case where the printer executes the maintenance operation regardless of the opening or closing of the cover, the printer does not stop the maintenance operation even if a user opens the cover. Accordingly, the user is required to wait for carrying out the user's maintenance until the printer completes the maintenance operation. Also the user may come in contact with the print head moving on the track when the user opens the cover.

Japanese Unexamined Patent Publication HEI 2(1990)-162056 discloses an ink-jet printer having a cover for covering a power supply switch, an opening/closure sensor for detecting an open/closed state of the cover, and a cap section for sealing a nozzle of a print head for preventing clogging owing to the drying of the nozzle when the print head is not in operation. During printing, the open/closed state of the cover is monitored. If the cover is opened, the printing is interrupted, the print head is moved to the cap section and the nozzle is sealed.

Japanese Unexamined Patent Publication HEI 2001-71587 discloses an ink-jet printer having a cover capable of opening an inside when an ink tank or a print head is replaced. In this printer, if the print head is located at the end of a forward way of a track when the user opens the cover, the print head moves to a maintenance section at a starting end of a track.

In the above-mentioned ink-jet printers, if they are placed in a dry environment, the nozzles become dry while the print heads move. Consequently the nozzles are liable to clog and the maintenance operation cannot be done effectively.

SUMMARY OF THE INVENTION

The present invention has been made in view of the above-mentioned problems, and an object thereof is to provide a printing apparatus offering an improved safety to users when the cover is opened and allowing a user's effective maintenance.

The present invention provides a printing apparatus comprising a print head section having a nozzle for discharging ink; a paper feed section for feeding paper in a paper feed direction; a movement section for reciprocally moving the print head along a track formed in a direction perpendicular to the paper feed direction; a maintenance section for performing a maintenance operation on the nozzle; a case for accommodating the above-mentioned sections; a cover attached to the case in an openable and closable manner; a detection section for detecting open and closed states of the cover and outputting detection signals representative of the open and closed states of the cover; and a control section for controlling drive of the movement section and the maintenance section according to the detection signals output by the detection section, wherein the maintenance section includes two maintenance stations mounted on both ends of the track, and the control section gives an instruction such that the print head moving to one of the maintenance stations is stopped at a stop position established on the track, in response to the detection signal representative of the open state of the cover.

That is, if a user opens the cover while the maintenance operation is being carried out on the print head, the print head moving toward one of the maintenance stations for the next maintenance step is stopped at the stop position established on the track. Accordingly, the print head does not traverse in front of the user, and the user can immediately carry out user's maintenance such as replacement of an ink tank and the print head on the stopped print head.

The control section, in response to the detection signal representative of the open state of the cover, may give an instruction such that the print head moving along the track is moved to one of the maintenance stations which is closer to the print head. With this construction, the user can immediately carry out user's maintenance such as replacement of the ink tank and the print head on the print head moved to the maintenance station. Also a nozzle of the print head can be inhibited from drying during a period when the maintenance operation is interrupted by the user's maintenance.

Further, after the print head is moved to the maintenance station, the control section may give an instruction such that the print head is moved again along the track and is stopped at the stop position. With this construction, the user can immediately carry out user's maintenance such as replacement of the ink tank and the print head on the stopped print head.

After the print head is stopped at the stop position, the control section may give an instruction such that the maintenance operation is resumed, in response to the detection signal representative of the closed state of the cover. With this construction, the user can carry out the user's maintenance safely, and also the maintenance operation initiated by the control section can be performed without delay.

According to a step of the maintenance operation at the time of detecting the open state of the cover, the control section may determine from which step the maintenance operation should be resumed, from a step next to said step or from the first step of the maintenance operation. With this construction, it is possible to avoid the interruption by the stopping of the print head of a step of the maintenance operation which is desirably performed continuously. Also, in the case where a step of the maintenance operation which need not be performed continuously is being performed at the time of detecting the open state of the cover, the step is interrupted and the user can immediately carry out the user's maintenance on the print head at the stop position.

For resuming the maintenance operation from the next step, the control section may select one of the two maintenance stations according to the step of the maintenance operation at the time of detecting the open state of the cover, and give an instruction such that the print head is moved to the selected one of the maintenance stations and the maintenance operation is resumed.

More particularly, in the case where the step of the maintenance operation at the time of detecting the open state of the cover is not affected by interruption, the maintenance operation is resumed from the next step. Such a step that is not affected by interruption is a step where the print head starts to move to a predetermine maintenance station for the first step of the maintenance operation, a step where a spitting step of causing the nozzle to discharge the ink for merely moistening the nozzle is finished, or the like.

On the other hand, in the case where the step of the maintenance operation at the time of detecting the open state of the cover is desirably performed continuously, for example, in the case of a capping step of wiping the nozzle, discharging the ink from the nozzle for moistening the nozzle and the cap and then capping the nozzle, the maintenance process is resumed from the first step of the maintenance operation for preventing the nozzle and a cap from becoming dry due to the interruption of the maintenance process.

Therefore, when the cover is closed, the maintenance operation can be resumed in an optimal way according to the step of the maintenance operation at the time of detecting the open state.

The step of the maintenance operation at the time of detecting the open state of the cover may be recognized according to a time having elapsed from the beginning of the maintenance operation. This constitution eliminates the need of a sensor such as an encoder verifying the position of the print head for performing the maintenance operation after the cover is closed, and thus simplifies the structure of the printing apparatus.

After a predetermined time elapses from the time of detecting the open state of the cover, the control section may give an instruction such that the print head stopped at the stop position is moved to one of the maintenance stations. This constitution prevents the nozzle and the cap from drying owing to a long interruption.

The present invention may provide a printing apparatus having maintenance stations provided with at least one of a wiper section for wiping the nozzle, an ink discharge section for causing the nozzle to discharge a predetermined amount of ink, a waste ink receiving section for receiving the discharged ink, a cap section for capping the nozzle and an ink suction section for sucking the ink from the nozzle, wherein the maintenance operation comprises at least one of the steps of wiping the nozzle, causing the nozzle to discharge the ink, sucking the ink from the nozzle and capping the nozzle.

In the printing apparatus provided with the above-described maintenance stations, since both the maintenance stations on the right and left sides are provided with the ink discharge sections, the spitting action of discharging the ink from the nozzles can be performed by the maintenance sections on both the sides. Therefore, when the open state is detected, the print head can immediately proceed to the spitting acting without crossing the stop position.

Also since both the maintenance stations on the right and left sides are provided with the wiper sections for wiping the nozzles, the wiping action of wiping the nozzle can be performed by the maintenance stations on both the sides. Therefore, when the open state is detected, the print head can immediately proceed to the wiping acting without crossing the stop position.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The embodiment of the present invention is now described with reference to the attached drawings, which should not be construed to limit the scope of the invention.

Figure 1:
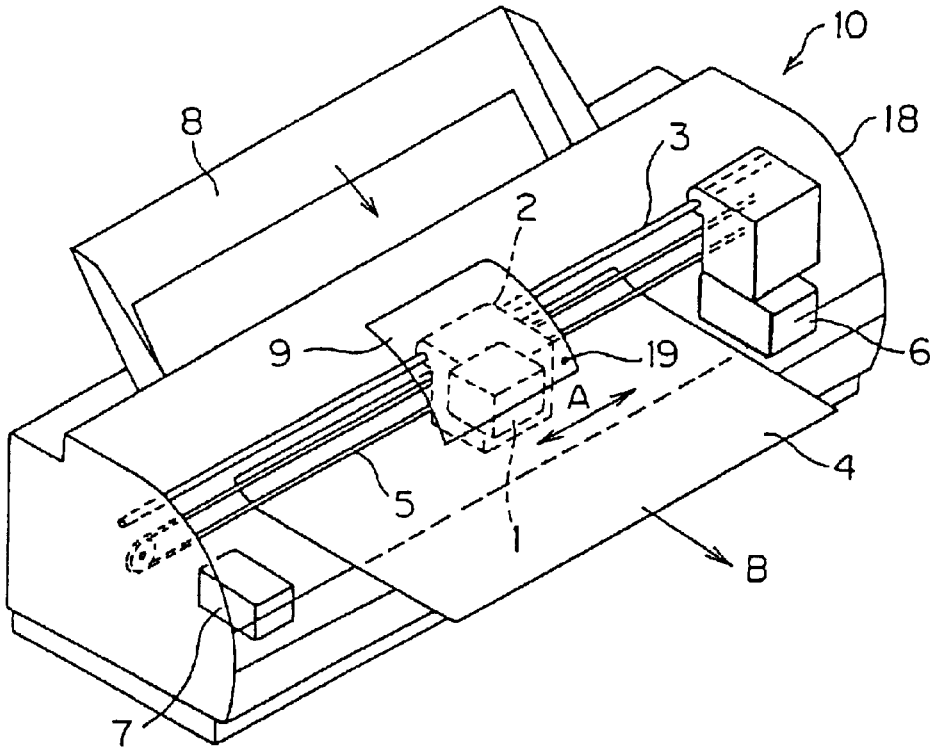
FIG. 1 is a perspective view illustrating a construction of a major part of an ink-jet printer in accordance with an embodiment of the printing apparatus of the present invention.

FIG. 1 is a perspective view illustrating a construction of a major part of an ink-jet printer in accordance with an embodiment of the printing apparatus of the present invention.

In an inkjet printer 10 shown in FIG. 1, a carriage 2 carrying an inkjet head 1 (referred to simply as a head hereinafter) is slidably supported on a guide shaft 3 (defining a track) and is moved by a drive belt 5 driven by a carriage motor (not shown) in a direction A (main scanning direction) indicated by a double-headed arrow A in the figure. Paper 4 is transported by a paper feed motor (not shown) from a paper feed section 8 in a direction B (secondary scanning direction) indicated by an arrow B in the figure. The head 1 is supplied with ink from an ink tank (not shown).

A cover 9 is attached to a central part of a front face of a case 18 in an openable and closable manner. A cover sensor 19 for detecting an open/closed state of the cover 9 is attached to an edge to an opening for the cover 9 formed in the case 18.

A right unit 6 which functions as a right maintenance station is provided at one end (i.e., the right end in FIG. 1) of the guide shaft 3, and a left unit 7 which functions as a left maintenance station is provided at the other end (i.e., the left end in FIG. 1) of the guide shaft 3.

Figure 2:
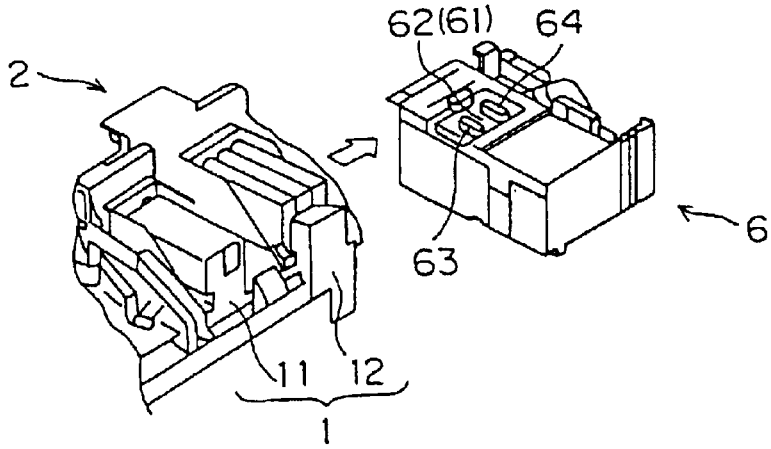
FIG. 2 is a perspective view illustrating a positional relationship between a carriage and a right unit shown in FIG. 1.

FIG. 2 is a perspective view illustrating a positional relationship between the carriage 2 and the right unit 6 when the carriage 2 carrying the head 1, supported slidably on the guide shaft 3, moves to the right unit 6.

As shown in FIG. 2, the carriage 2 carries the head 1 having a black ink head 11 and a color ink head 12 and can move to a position such that nozzles (not shown) formed in a lower part of the head 1 face an upper surface of the right unit 6 (and the left unit 7). In the following description, the movement of the carriage 2 carrying the head 1 is referred to as the movement of the head 1 for convenience.

The right unit 6 is provided with a purging suction cap 63 for the black ink head 11, a purging suction cap 64 for the color ink head 12 and a wiper blade 62 for the color ink head 12.

The left unit 7 is provided with a wiper blade for the black ink head 11, a purging suction cap 63 for the black ink head 11 and a purging suction cap 64 for the color ink head 12.

The wiper blades 62 and 61 are provided between the suction caps 63 and 64.

Figure 3:
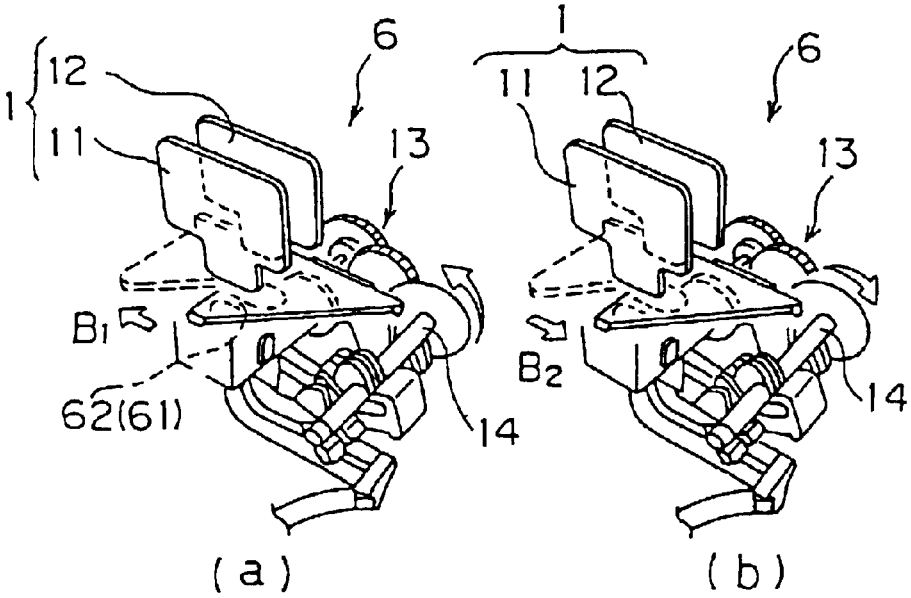
FIGS. 3(*a*) and 3(*b*) are perspective views illustrating a construction of a wiper section of the right unit shown in FIG. 1.

FIGS. 3(*a*) and 3(*b*) are perspective views illustrating a construction of a wiper section of the right unit 6 (or the left unit 7).

As shown in FIGS. 3(*a*) and 3(*b*), the right unit 6 is set slidably in directions B1 and B2 indicated by arrows B1 and B2 (secondary scanning directions) by normal and reverse rotation of an output axis 14 of a series of gears 13 driven by a maintenance motor (not shown), and is slid in the directions B1 and B2.

When the head 1 is moved to above the wiper blade 62 (or 61) as shown in FIG. 2, the right unit 6 is moved reciprocally in the directions B1 and B2 by the normal and reverse rotation of the output axis 14 as shown in FIG. 3, and thereby the nozzles of the head 1 are wiped by the wiper blade 62 (or 61) (wiping action).

Figure 4:
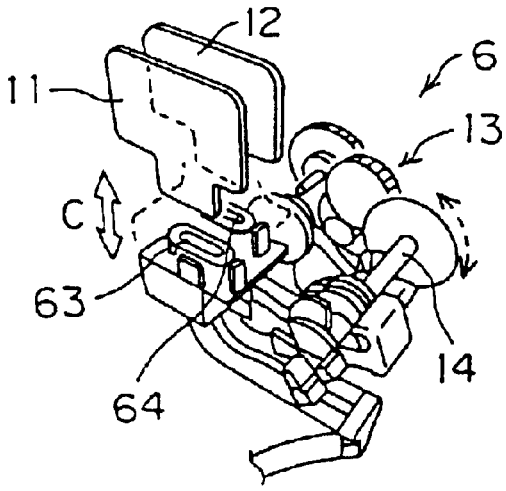
FIG. 4 is a perspective view illustrating a construction of a cap section of the right unit shown in FIG. 1.

FIG. 4 is a perspective view illustrating a construction of a cap section of the right unit 6.

As shown in FIG. 4, the right unit 6 is provided with a raising and lowering mechanism (not shown) for raising and lowering the right unit 6 with respect to the case 18 in a direction indicated by an arrow C by the normal and reverse rotation of the output axis 14 of the series of gears 13 driven by the maintenance motor.

The right unit 6 is raised by the normal rotation of the output axis 14, and thereby the suction caps 63 and 64 cap the nozzles of the head 1 (capping action). The right unit 6 is lowered by the reverse rotation of the output axis 14, and thereby the suction caps 63 and 64 part from the nozzles of the head 1 (decapping action).

Figure 5:
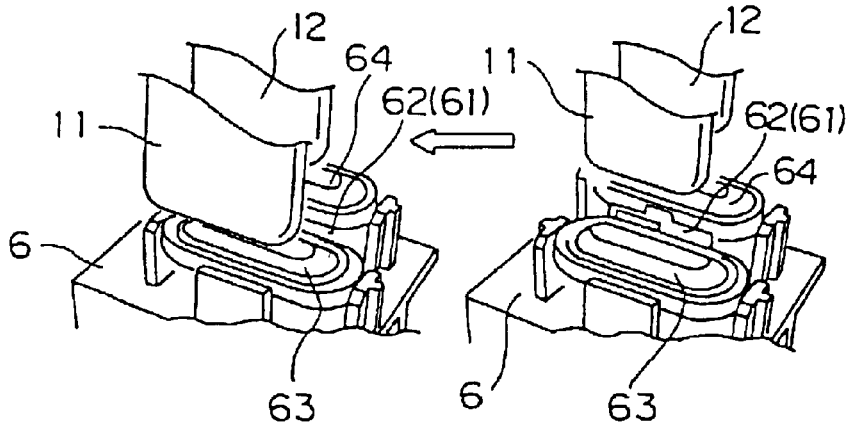
FIG. 5 is a perspective view illustrating a construction of an ink discharge section of a head shown in FIG. 1.

FIG. 5 is a perspective view illustrating a construction of an ink discharge section of the head 1.

As shown in FIG. 5, when the head 1 is moved to be positioned on the suction caps 63 and 64, all the nozzles of the black ink head 11 and the color ink head 12 sequentially discharge a predetermined amount of ink into the suction caps 63 and 64 by the drive of a pressure generating means (not shown) within the head 1 (spitting action).

Figure 6:
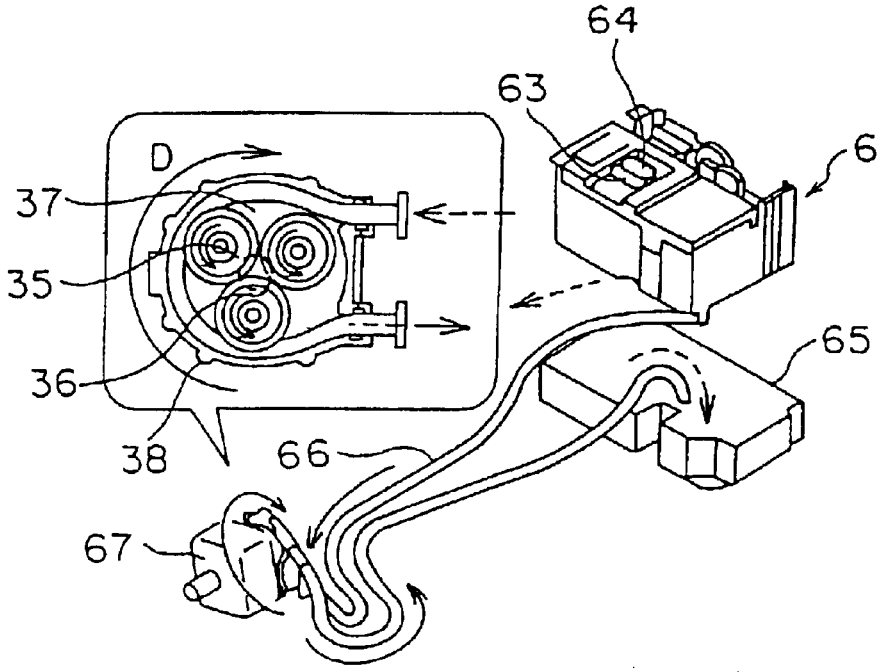
FIG. 6 is a perspective view illustrating a construction of an ink suction section in the right unit shown in FIG. 1.

FIG. 6 is a perspective view illustrating a construction of an ink suction section in the right unit 6.

As shown in FIG. 6, the suction caps 63 and 64 of the right unit 6 are connected to a pit 65 accommodating a waste ink absorbing member via a flexible tube 66.

A suction pump 67 is connected to the tube 66.

As shown in an enlarged view in the figure, the suction pump 67 is a so-called squeezing pump provided with a disk 37 having a rotation axis 36 and a plurality of rollers 35 rotatably attached thereto, and a housing 38 for sandwiching the tube 66 between the housing and circumferential faces of the rollers 35.

When the disk 36 is rotated in a direction D indicated by an arrow D by the drive of a motor (not shown) connected to the rotation axis 36, the tube 66 can be squeezed between the rollers 35 and the housing 38 to send a waste ink in a direction indicated by a dotted arrow.

Figure 7:
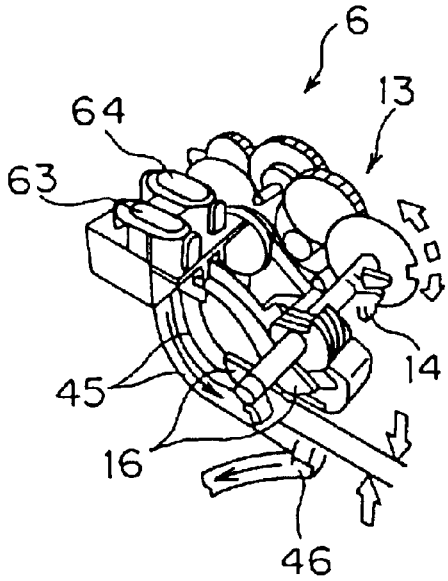
FIGS. 7(*a*) and 7(*b*) are perspective views illustrating a switching mechanism between a black ink head and a color ink head at ink suction in the right unit shown in FIG. 1.
Figure 7:
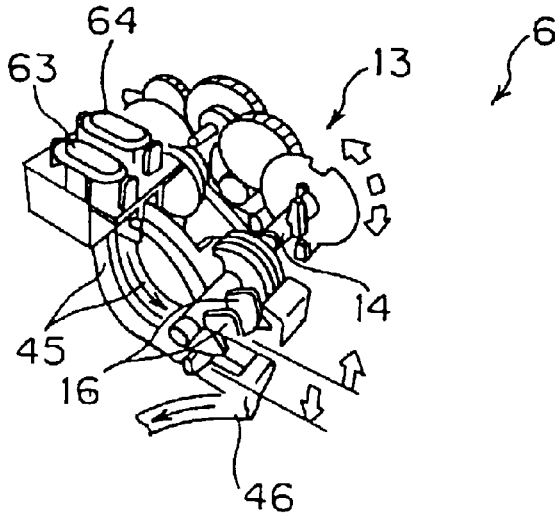

FIGS. 7(*a*) and 7(*b*) are perspective views illustrating a switching mechanism between the black ink head 11 and the color ink head 12 when ink is sucked in the right unit 6.

As shown in FIGS. 7(*a*) and 7(*b*), the right unit 6 has a two fluid transport paths 45 made of flexible tubes, a Y-shaped collection tube 46 and an opening/closing mechanism for the fluid transport paths 45.

The fluid transport paths 45 open to the suction caps 63 and 64 at their one ends, and the fluid transport paths 45 is connected to two opening of the Y-shaped collection tube 46 at their other ends. The rest opening of the Y-shaped collection tube 46 is connected to the tube 66.

The opening/closing mechanism has two nail members 16 unrotatably supported on a front portion of the output axis 14. The two nail members 16 are fitted to the output axis 14 with arc portions forming circumferential faces of the nail members 16 being in different phases.

With the above-described construction, it is possible to sequentially perform an opening action and a closing action on the fluid transport paths 45, that is, an action of putting pressure on the fluid transport paths 45 with the arc portion forming the circumferential faces of the nail members 16, and an action of releasing the pressure. Accordingly, the fluid transport paths 45 can be closed at different timings by the above-described actions.

In the ink suction section shown in FIG. 6 and FIGS. 7(*a*) and 7(*b*), the fluid transport paths are closed by the above-described pressing action of the nail members 16, a negative pressure is generated in the tube 66 by the drive of the suction pump 67, and in this state, the nail members 16 make the above-described pressure releasing action. Thereby clogging can be removed from all the nozzles of the head 1, and also the ink remaining in the tube 66 can be discharged into the pit 65 (ink suction action).

The right unit 6 is provided with the aforesaid wiper section, ink discharge section, waste ink receiving section, cap section and ink suction section. The left unit 7 is provided with the aforesaid wiper section, ink discharge section and waste ink receiving section. The remaining amount of ink in the ink tanks for the black ink head 11 and the color ink head 12 is monitored by an ink sensor 112 described later for detecting ink information.

Figure 8:
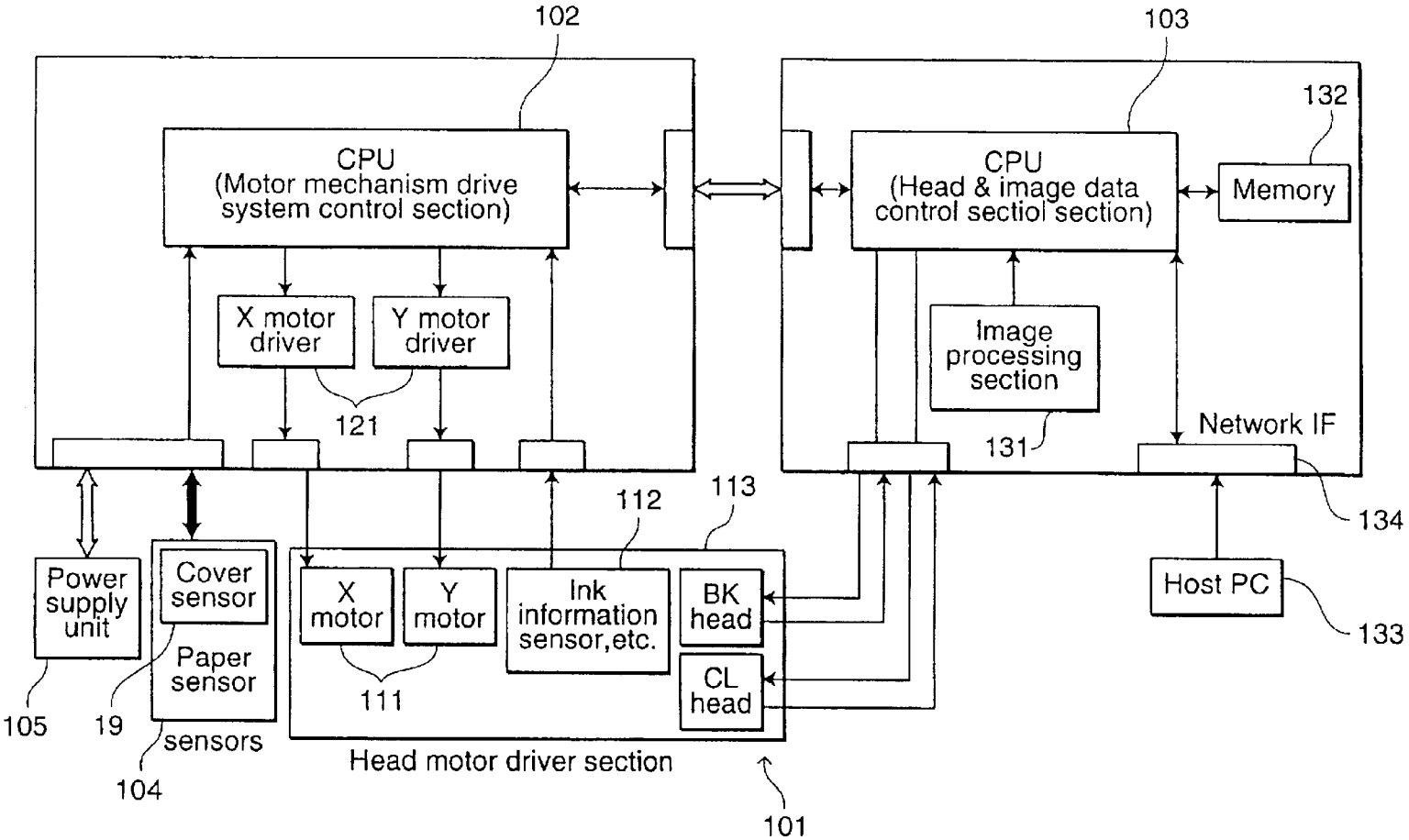
FIG. 8 is a block diagram illustrating a construction of an electrical circuit of the ink-jet printer shown in FIG. 1.

FIG. 8 is a block diagram illustrating a construction of an electrical circuit of the ink-jet printer 10 shown.

The ink-jet printer 10 has drive systems and control systems including a head motor drive section 101, a motor and mechanism drive system control section (CPU) 102, a head and image data control section (CPU) 103, sensors 104 and a power supply unit 105.

The head motor drive section 101 is comprised of X and Y motors 111 used for scanning of the head 1, an ink sensor 112 for detecting ink information such as a remaining ink amount in the ink tanks, a drive section 113 for discharging ink from the nozzles of the black ink head 11 and the color ink head 12, and the like.

The motor and mechanism drive system control section 102 is connected to the X and Y scanning motors 111 via drivers 121 for the X and Y scanning motors 111.

The head and image data control section 103 is connected to an image processing section 131 and a memory 132 and is provided with a network IF 134 capable of connecting to an external host PC 133.

In the ink-jet printer 10, when the cover sensor 19 detects the open/closed state of the cover 9, a detection signal is transmitted to the motor and mechanism drive system control section 102 and then to the head and image data control section 103. The head and image data control section 103 determines what one of a plurality of maintenance actions should be taken, and instructs the motor and mechanism drive system control section 102 to perform the determined maintenance action. The motor and mechanism drive system control section 102 performs the instructed maintenance action.

The maintenance actions in the ink-jet printer 10 are now described.

Capping Action

First, as shown in FIG. 4, the right unit 6 is raised by the normal rotation of the output axis 14 of the series of gears 13. Thereby the nozzles of the head 1 are capped by the suction caps 63 and 64 (capping action). Next, as shown in FIG. 2, the carriage 2 is moved so that the head 1 is positioned on the wiper blade 62 (or 61). Then, as shown in FIG. 3, the right unit 6 is moved in the directions B1 and B2 by the normal and reverse rotation of the series of gears 13, and thereby the nozzles of the head 1 are wiped by the wiper blade 62 (or 63) (wiping action.

Subsequently, as shown in FIG. 5, the head 1 is moved onto the suction caps 63 and 64. A predetermined amount of ink is sequentially discharged from the nozzles of the black ink head 11 and the color ink head 12 into the suction caps 63 and 64 by the drive of the pressure generating means (not shown) of the head 1 (spitting action for preventing the suctions caps 63 and 64 from drying).

Subsequently, the right unit 6 is lowered by the reverse rotation of the output axis 14 of the series of gears 13, and thereby the suction caps 63 and 64 part from the nozzles of the head 1 (decapping action). Then, after the above-mentioned spitting action for preventing the suction caps 63 and 64 from drying and wiping action are performed at least once, the above-mentioned spitting action is performed. Lastly, the head 1 is moved to a cap position.

Priming Action

The priming action is performed when a user instructs the ink-jet printer 10 to perform the priming action by operating an input section or the like, when the ink tank or the head 1 is replaced, or when the ink sensor 112 detects the amount of ink discharged from the nozzles exceeding a predetermined value.

First, after the head 1 is moved to the cap position and the above-described capping action is performed, then in the ink suction section, the liquid transport paths 45 are closed by the pressing action of the nail members 16, and a negative pressure is generated in the tube 66 by the drive of the suction pump 67. In this state, the nail members 16 perform the above-described pressure releasing action. Thereby clogging is removed from the nozzles of the head 1, and also the ink remaining in the tube 66 is discharged into the pit 65 (ink suction action).

Subsequently, after the above-described wiping action and decapping action are performed simultaneously, the spitting action of the black ink head 11 is performed at the left unit 7, and then the spitting action of the color ink head 12 is performed at the left unit 7.

Then, the above-described capping action is performed.

The above-described spitting action is performed at printing and at non-printing. The spitting action at printing is performed by the movement of the head 1 to the right unit after lapse of a predetermined time period during printing.

The spiting action at non-printing is performed on the capped head 1 for preventing the nozzles from drying every certain time), for example, every two hours. Usually, the spitting action is performed at the left unit 7, but in urgent need, for example, if the cover 9 opens when movement from the right unit 6 to the left unit 7 starts after the priming action, the spitting action is performed at the right unit 6.

Figure 9:
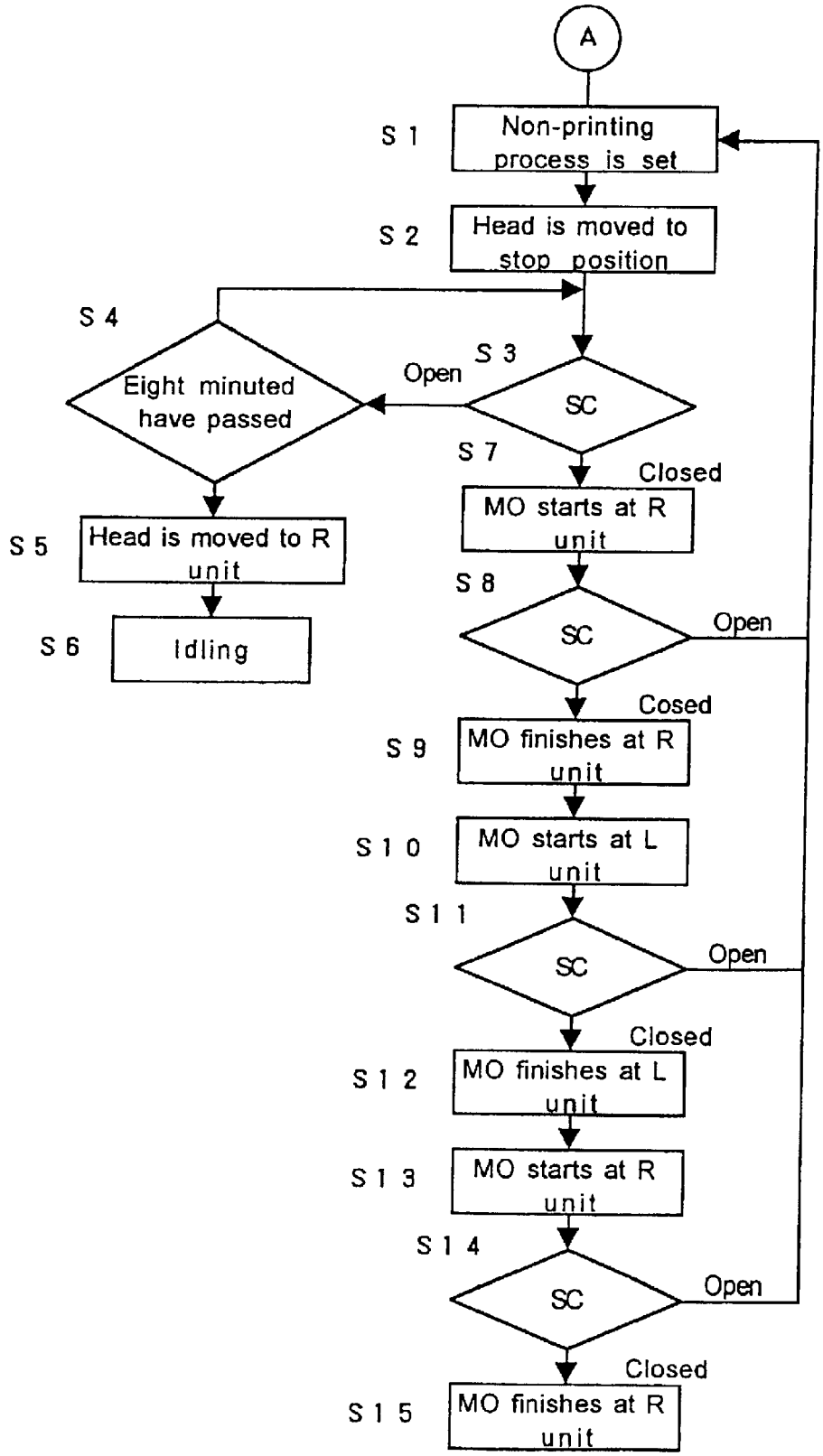
FIG. 9 is a flowchart explaining a maintenance operation when a cover sensor detects an open/closed state of a cover at non-printing.
Figure 10:
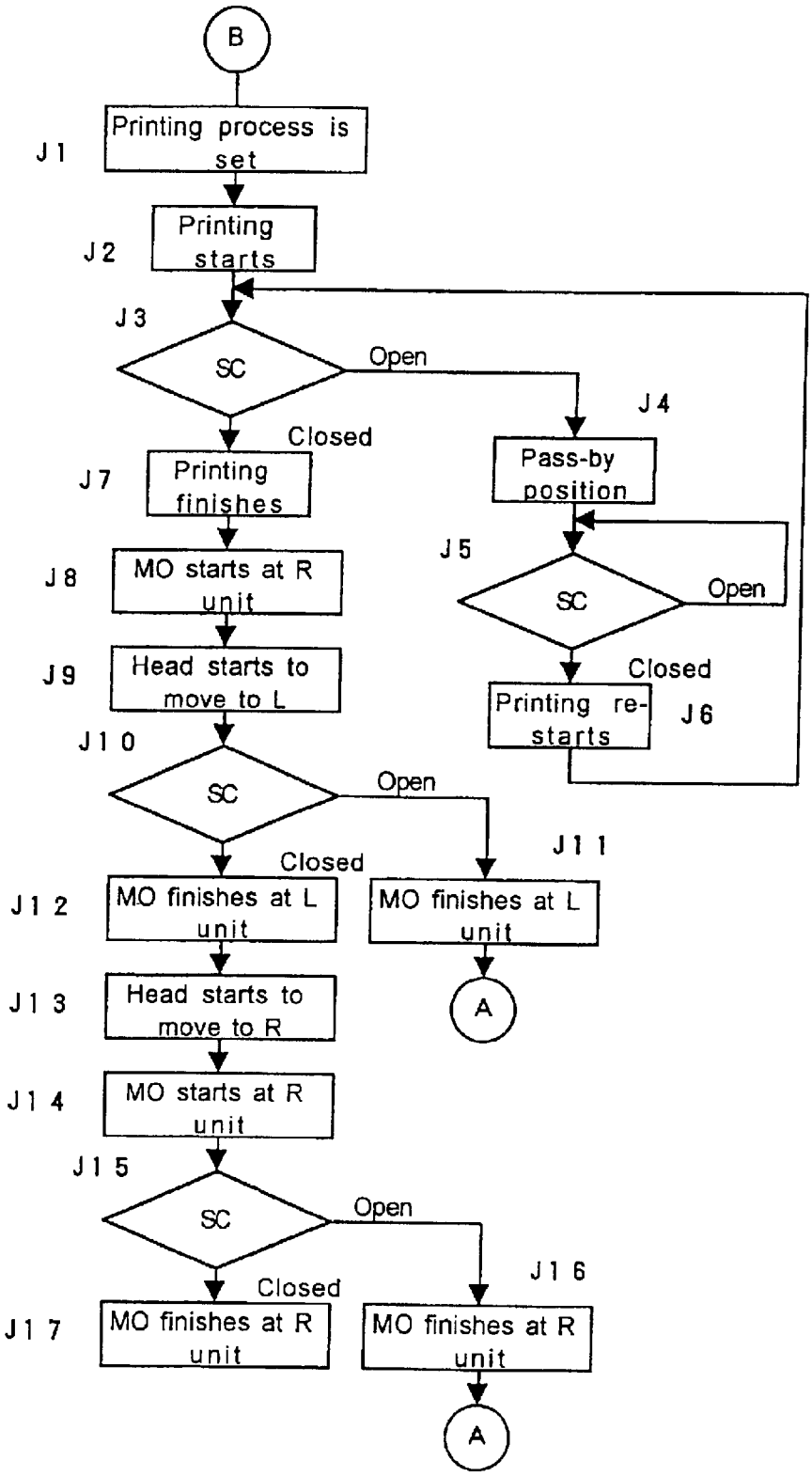
FIG. 10 is a flowchart explaining a maintenance operation when a cover sensor detects an open/closed state of a cover at printing and at the end of printing.
Figure 11:
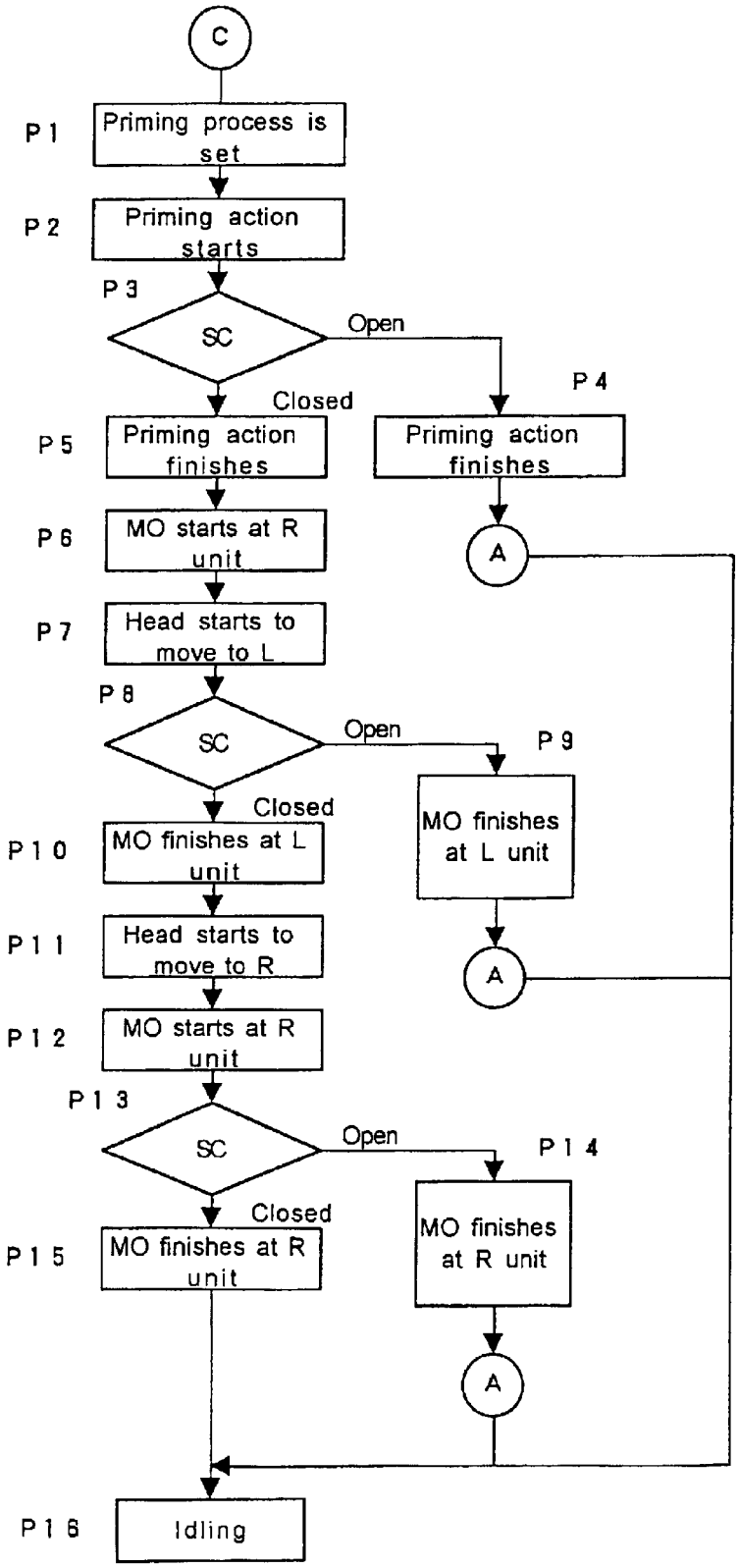
FIG. 11 is a flowchart explaining a maintenance operation when a cover sensor detects an open/closed state of a cover at a priming process and at the end of the priming process.

Next, the timing of the maintenance actions based on the detection of the opening/closing of the cover 9 in the inkjet printer 10 is described with use of flowcharts shown in FIG. 9 to FIG. 11 with the operation of the motor and mechanism drive system control section 102 mainly explained.

In FIG. 9 to FIG. 11, SC, MO, R and L represent the state of the cover 9, the maintenance operation, right and left respectively.

FIG. 9 is a flowchart explaining the maintenance operation when the cover sensor 19 detects the open/closed state of the cover 9 at non-printing, i.e., during standby when a printing instruction is not given.

Referring to FIG. 9, a non-printing process is set. The head 1 moves to a stop position indicated by a dotted line in FIG. 1, and the cover sensor 19 detects the open/closed state of the cover 9 (Step S1 to S3). If the cover sensor 19 detects the open state of the cover 9, then the cover sensor 19 judges whether or not eight minutes have elapsed in this state. If eight minutes have elapsed, then the head 1 is moved to the right unit 6, the capping action is performed and the process goes to an idling state (Steps S4 to S6).

If the cover sensor 19 detects the closed state of the cover 9, the head 1 is moved to the right unit 6 and the capping action is performed (Step S7).

Thereafter, if the cover sensor 19 detects the open state of the cover 9, then the process goes to step S1. If the cover remains closed, the maintenance operation at the right unit 6 is finished, the head 1 is instructed to move to the left unit 7 and the process goes to the spitting action of the black ink head 11 (Steps S8 to S10).

Thereafter, if the cover sensor 19 detects the open state of the cover 9, then the process goes to step S1. If the cover 9 remains closed, the maintenance operation at the left unit 7 is finished, the head 1 is instructed to move to the right unit 6, and the process goes to the spitting action of the color ink head 12 (Steps S11 to S13).

If the cover sensor 19 detects the open state of the cover 9, then the process goes to step S1. If the cover 9 remains closed, the spitting action and the capping action at the right unit 6 are finished (Steps S14 to S15).

FIG. 10 is a flowchart explaining the maintenance operation when the cover sensor 19 detects the open/closed state of the cover 9 at printing and at the end of printing.

In FIG. 10, when a printing process is set and printing is started, the head 1 moves in the direction A in FIG. 1 to print on paper and the cover sensor 19 detects the open/closed state of the cover 9 (Steps J1 to J3).

If the cover sensor 19 detects the open state of the cover 9 during printing, the head 1 is moved to a pass-by position by the carriage 2. As soon as the closed state of the cover 9 is detected, printing is resumed (Steps J4 to J6). The above-mentioned pass-by position is set at a place from the right unit 6 to the stop position of the head 1 where the head 1 does not pass the wiper blade 62.

If it is judged that printing finishes with the cover 9 remaining in the closed state, the head 1 is moved to the right unit 6, and the process goes to the capping action of the black ink head 11 (Steps J7 to J8).

Thereafter, when the decapping action finishes at the right unit 6, the head 1 is instructed to move to the left unit 7, and the process goes to the spitting action of the black ink head 11 (Step J9).

If the cover sensor 19 detects the open state of the cover 9, then the process stops going to the spitting action of the black ink head 11 and goes to step S1 of FIG. 9 (Steps J10 to J11).

That is, at the above mentioned detection of the open state, if the head 1 is positioned at the right unit 6, the spitting action of the black ink head 11, which should be originally performed at the left unit 7, is performed at the right unit 6 instead.

At the above mentioned detection of the open state, if the head 1 is moved to the right with respect to the stop position (a position nearer to the right unit 6), the head 1 is stopped at the stop position. Further, at the above mentioned detection of the open state, if the head 1 is moved to the left with respect to the stop position (a position nearer to the left unit 7), the head 1 is moved to the left unit 7 and the spitting action of the black ink head 11 is performed at the left unit 7.

If the cover 9 remains closed, the spitting action at the left unit 7 is finished, the head 1 is instructed to move to the right unit 6, and the process goes to the capping action of the color ink head 12 (Steps J12 to J14).

If the cover sensor 19 detects the open state of the cover 9, the process stops going to the spitting action of the color ink head 12 and goes to Step Si in FIG. 9 (Steps J15 to J16).

If the cover 9 remains closed, the spitting action and the capping action at the right unit 6 are finished (Step J17).

Meanwhile the process finishes by going to step S1 in FIG. 9 from steps J11 and J16.

FIG. 11 is a flowchart explaining the maintenance operation when the cover sensor 19 detects the open/closed state of the cover 9 during a priming process and at the end of the priming process.

In FIG. 11, when the priming process is set and the priming process is started, the head 1 is moved to the right unit 6 to start the priming action (Steps P1 to P2).

If the cover sensor 19 detects the open state of the cover 9, the priming process is finished and then the process goes to step S1 of FIG. 9 (Steps P3 to P4).

If the cover 9 is in the closed state and the priming action finishes, the head 1 is moved to the right unit 9 and the process goes to the capping action of the black ink head 11 (steps P5 to P6). When the decapping action finishes at the right unit 6, the head 1 is instructed to move to the left unit 7, and the process goes to the spitting action of the black ink head 11 (step P7).

If the cover sensor 19 detects the open state of the cover 9, the process stops going to the spitting action of the black ink head 11 and goes to step S1 of FIG. 9 (Steps P8 to P9).

If the cover 9 remains closed, the process stops the spitting action at the left unit 7, the head 1 is instructed to move to the right unit 6, and the process goes to the capping action of the color ink head 12 (Steps P10 to P12).

If the cover sensor 19 detects the open state of the cover 9, the process stops going to the spitting action of the color ink head 12, and the process goes to step S1 of FIG. 9 (Steps P13 to P14).

If the cover is closed, the spitting action and the capping action at the right unit 6 are finished, and the process goes to idling (Steps P15 to P16).

Meanwhile the process finishes by going to step S1 in FIG. 9 from step P14, and then the process goes to step P16 and idling.

In steps S8, S11, S14, J10, J15, P8 and P13 of FIG. 9 to FIG. 11, if the head 1 is under the maintenance operation at the right unit 6 or the left unit 7 when the cover sensor 19 detects the open state of the cover 9, the maintenance operation is finished and then the process goes to S1 of FIG. 1. If the head 1 is moving for the next step of the maintenance operation, the process goes to step Si of FIG. 9 immediately.

Effect of the Invention

According to the present invention, the print head does not traverse the sight of the user, and the user can carry out the user's maintenance such as the replacement of the ink tank and the print head on the stopped print head immediately.

Steps of the maintenance operation that are desirably performed continuously can escape from being interrupted by the stopping of the print head. Furthermore, steps of the maintenance operation that need not be performed continuously can be interrupted, and thereby, the user's maintenance can be performed on the print head at the stop position immediately.

Therefore, after the cover is closed, the maintenance operation can be resumed in the optimal way according to the respective steps of the maintenance operation.

The step of the maintenance operation at the time of detecting the open state of the cover is recognized according to a time having elapsed from the beginning of the maintenance operation. Accordingly, a sensor such as an encoder for verifying the position of the print head is not required for performing the maintenance operation after the cover is closed. Therefore, the structure of the printing apparatus can be simplified.

After a predetermined time elapses from the time of detecting the open state of the cover, the control section gives an instruction such that the print head stopped at the stop position is moved to one of the maintenance stations. Accordingly, the nozzle, the cap and others can be presented from drying owing to a long interruption.

Since both the right and left maintenance stations are provided with the discharge sections for discharging ink, both the maintenance stations can perform the spitting action of discharging the ink from the nozzle. Therefore, when the open state is detected, the print head can goes to the spitting action immediately without crossing the stop position.

Since both the right and left maintenance stations are provided with the wiper sections for wiping the nozzles, both the maintenance stations can perform the wiping action of wiping the nozzles. Therefore, when the open state is detected, the print head can goes to the wiping action without crossing the stop position.

The present invention provides a printing apparatus offering improved safety to a user when the user opens the cover and also allowing the user's maintenance to be performed efficiently.

What is claimed is:

1. A printing apparatus comprising:

a print head section having a nozzle for discharging ink;

a paper feed section for feeding paper in a paper feed direction;

a movement section for reciprocally moving the print head along a track formed in a direction perpendicular to the paper feed direction;

a maintenance section for performing a maintenance operation on the nozzle;

a case for accommodating the above-mentioned sections;

a cover attached to the case in an openable and closable manner;

a detection section for detecting open and closed states of the cover and outputting detection signals representative of the open and closed states of the cover; and a control section for controlling drive of the movement section and the maintenance section according to the detection signals output by the detection section, wherein the maintenance section includes two maintenance stations mounted on both ends of the track, and the control section gives an instruction such that the print head moving to one of the maintenance stations is stopped at a stop position established on the track, in response to the detection signal representative of the open state of the cover.

2. The printing apparatus of claim 1, wherein the control section gives an instruction such that the print head moving along the track is moved to one of the maintenance stations which is closer to the print head, in response to the detection signal representative of the open state of the cover.

3. The printing apparatus of claim 2, wherein, after the print head is moved to the maintenance station, the control section gives an instruction such that the print head is moved again along the track and is stopped at the stop position.

4. The printing apparatus of claim 1, wherein, after the print head is stopped at the stop position, the control section gives an instruction such that the maintenance operation is resumed, in response to the detection signal representative of the closed state of the cover.

5. The printing apparatus of claim 4, wherein, according to a step of the maintenance operation at the time of detecting the open state of the cover, the control section determines from which step the maintenance operation should be resumed, from a step next to said step or from the first step of the maintenance operation.

6. The printing apparatus of claim 5, wherein, for resuming the maintenance operation from the next step, the control section selects one of the two maintenance stations according to the step of the maintenance operation at the time of detecting the open state of the cover, and gives an instruction such that the print head is moved to the selected one of the maintenance stations and the maintenance operation is resumed.

7. The printing apparatus of claim 5, wherein the step of the maintenance operation at the time of detecting the open state of the cover is recognized according to a time having elapsed from the beginning of the maintenance operation.

8. The printing apparatus of claim 1, wherein, after a predetermined time elapses from the time of detecting the open state of the cover, the control section gives an instruction such that the print head stopped at the stop position is moved to one of the maintenance stations.

9. The printing apparatus of claim 1, wherein the maintenance stations comprise at least one of a wiper section for wiping the nozzle, an ink discharge section for causing the nozzle to discharge a predetermined amount of the ink, a waste ink receiving section for receiving the discharged ink, a cap section for capping the nozzle and an ink suction section for sucking the ink from the nozzle.

10. The printing apparatus of claim 1, wherein the maintenance operation comprises at least one of the steps of wiping the nozzle, causing the nozzle to discharge the ink, sucking the ink from the nozzle and capping the nozzle.

11. The printing apparatus of claim 1, wherein the stop position for the print head is established at a place which allows an external access for a user to perform a maintenance operation on the print head when the cover is opened.

* * * * *